US005747430A

United States Patent [19]

Matsushita et al.

[11] Patent Number: 5,747,430

[45] Date of Patent: May 5, 1998

[54] LUBRICANT COMPOSITION

[75] Inventors: Shozo Matsushita; Naomi Suzuki, both of Saitama-Ken, Japan

[73] Assignee: Exxon Research and Engineering Company, Florham Park, N.J.

[21] Appl. No.: 750,263

[22] PCT Filed: Jul. 8, 1995

[86] PCT No.: PCT/US95/09564

§ 371 Date: Jan. 24, 1997

§ 102(e) Date: Jan. 24, 1997

[87] PCT Pub. No.: WO96/03480

PCT Pub. Date: Feb. 8, 1996

[30] Foreign Application Priority Data

Jul. 28, 1994 [JP] Japan ..... 6-176315

[51] Int. Cl.[6] ..... C10M 133/00; C10M 139/00; C10M 141/10

[52] U.S. Cl. ..... 508/209; 508/206; 508/559; 508/562

[58] Field of Search ..... 508/206, 209, 508/207, 208, 548, 559, 579; C10M 155/02, 157/00

[56] References Cited

U.S. PATENT DOCUMENTS

| | | | |
|---|---|---|---|
| 2,680,095 | 6/1954 | Hotten et al. | 508/208 |
| 2,839,468 | 6/1958 | Stewart et al. | 508/209 |
| 3,235,501 | 2/1966 | Waldmann | 508/208 |
| 3,740,352 | 6/1973 | Sommers | 508/209 |
| 3,791,488 | 2/1974 | Rowe et al. | 508/208 |
| 3,928,218 | 12/1975 | Rowe et al. | 508/208 |
| 3,928,219 | 12/1975 | Papay et al. | 508/559 |
| 4,059,534 | 11/1977 | Morro et al. | 508/208 |
| 4,088,591 | 5/1978 | Brown | 508/208 |
| 4,248,724 | 2/1981 | MacIntosh | 508/208 |
| 4,305,834 | 12/1981 | Barber et al. | 508/559 |

FOREIGN PATENT DOCUMENTS

| | | |
|---|---|---|
| 279027 | 5/1990 | Germany . |
| 279028 | 5/1990 | Germany . |

*Primary Examiner*—Jacqueline V. Howard
*Assistant Examiner*—Cephia D. Toomer
*Attorney, Agent, or Firm*—Joseph J. Allocca

[57] ABSTRACT

The lubricant composition of the present invention is characterized in that 1 ppm to 500 ppm of polysiloxane with a viscosity of 1,000 $mm^2/s$ to 100,000 $mm^2/s$ at 40° C. and 1 ppm to 5,000 ppm of ethylene glycol-propylene glycol polymer or a derivative thereof are blended with a base oil with a viscosity of 10 $mm^2/s$ to 700 $mm^2/s$ at 40 ° C. Because the lubricant composition of the present invention has excellent anti-foaming property, particularly in lubricants of high viscosity and at higher temperature, the composition is useful as a lubricant composition for use as bearing oil such as a lubricant for paper machine, hydraulic oil for injection molding press, and a lubricant for film orientation machine.

3 Claims, No Drawings

LUBRICANT COMPOSITION

BACKGROUND OF THE INVENTION

This application is a 371 of PCT/US95/09564, filed Jul. 8, 1995.

1. Field of the Invention

The present invention relates to a lubricant composition to be used as a bearing oil such as a lubricant for paper machine, hydraulic oil for injection molding press, and a lubricant for film orientation machine. More specifically, the present invention relates to a lubricant composition with excellent anti-foaming property in particular.

2. Description of the Related Art

Generally, additives to be blended in lubricants are mostly polar compounds, which are surface active. Therefore, when they are added to lubricant base oils, foaming readily occurs.

Furthermore, when lubricants are oxidized and deteriorated during use, or as additives decompose, highly polar oxides may be formed. The increase in polarity makes the lubricants more surface active, increasing the tendency of foaming.

When lubricants are foaming, the following drawbacks may occur problematically;

(1) hydraulic operation is deteriorated because of the increase in compaction of lubricants;

(2) the efficiency of hydraulic pumps decreases;

(3) oil supply into a frictional part is insufficient, causing wear, seizing, and the like;

(4) oxidation is facilitated because of the increase in the contact area between lubricants and air, and the like.

Thus, generally, dimethylsilicones (dimethylsiloxanes) have been most commonly used as an anti-foaming agent for lubricants. One or more dimethylsilicones with a viscosity of 100 $mm^2/s$ to 100,000 $mm^2/s$ at 40° C. may be used depending on the base composition of lubricants and the temperature at which lubricants are used.

Generally, anti-foaming property of a lubricant is assessed by a testing method defined by JIS K2518, wherein foaming degree and stability are determined while changing oil temperatures (they are measured at a low temperature of 24° C.). Maximum oil temperature is 95.5° C. Foaming degree and foaming stability are preferably 50 ml or less and 0 ml, respectively. From the respect of the standard, satisfactory results can be brought about by adding about 100 ppm of an anti-foaming agent, e.g., dimethylsiloxane, to a lubricant.

During actual use, the oil temperature is likely to be higher because of the compaction and high power modification of systems. Therefore, the frequency of the elevation of the temperature over 100° C. or more has increased.

Hence, oxidation stability and anti-foaming property against high temperatures are now quite important properties.

The method for assessing the anti-foaming property of lubricants at an oil temperature about 100° C. is illustrated by the ILSAC (International Lubricant Standard Committee) method for assessing the anti-foaming property of an oil at an oil temperature of 150° C.

Lubricants with a higher viscosity produce foam of a larger film thickness, resulting in poor anti-foaming property.

According to the ILSAC test method at 150° C., even after 1 to 100 ppm of dimethylsilicone is added to a lubricant with a viscosity of 68 $mm^2/s$ or more at 40° C., the lubricant has a foaming degree and foaming stability, both of 100 ml or more, so dimethylsilicone cannot improve the anti-foaming property thereof. If dimethylsilicone is added at 100 ppm or more, dimethylsilicone is uniformly dispersed into oil in a limited manner, so dimethylsilicone is precipitated with no improvement of the anti-foaming property.

The objective of the present invention is to provide a lubricant composition with excellent anti-foaming property under the conditions of higher temperatures.

SUMMARY OF THE INVENTION

The present invention is characterized in that 1 ppm to 500 ppm of organopolysiloxane with a viscosity of 1,000 $mm^2/s$ to 100,000 $mm^2/s$ at 40° C. and 1 ppm to 5,000 ppm of ethylene glycol/propylene glycol polymer or a derivative thereof are blended with a base oil with a viscosity of 10 $mm^2/s$ to 700 $mm^2/s$ at 40° C.

The base oil includes mineral oils, synthetic hydrocarbons such as poly-α-olefins, alkylbenzene, and the like, esters, polyalkylene glycol, alkyldiphenyl ether and alkyldiphenyl, and the like, or the mixture oil thereof.

The mineral oil includes 60 Neutral oil and 100 Neutral oil, which are produced through solvent purification and hydrogenation purification, and base oils of low flow points, produced by modifying the low-temperature fluidity of the aforementioned base oils through the removal of wax components therefrom. They may be used singly or in combination thereof at an appropriate ratio.

The poly-α-olefins include a single polymer of one species selected from olefin hydrocarbons which may or may not have a branched chain of 2 to 14 carbon atoms, preferably 4 to 12 carbon atoms, or a copolymer of two or more species selected from the olefin hydrocarbons, the polymer and the copolymer having an average molecular weight of 100 to about 2,000, preferably 200 to about 1,000. Preferably, the poly-α-olefin is in the form without unsaturated bonds which have been removed by hydrogenation.

The alkylbenzene includes an oil primarily containing dialkylated aromatic hydrocarbon as a by-product of the alkylation process of an aromatic hydrocarbon such as benzene and toluene by Friedel-Craft reaction to prepare raw materials for detergents. The alkyl group includes any of those alkyl groups in linear chain or branched chain.

The ester base oil includes polyol esters and diesters, which may be used singly or in combination. The ester such as polyol ester and diester includes polyol esters of an aliphatic polyhydric alcohol and a linear or branched fatty acid, partial esters of an aliphatic polyhydric alcohol and a linear or branched fatty acid, diesters of neopentyl glycol and a linear or branched fatty acid having 8 to 20 carbon atoms, complex esters of a partial ester of an aliphatic polyhydric alcohol and a linear or branched fatty acid with a linear or branched aliphatic dibasic acid or an aromatic dibasic acid, dialkyl esters of a linear or branched aliphatic dibasic acid, dialkyl esters of an aromatic dibasic acid.

Among the aforementioned base oils, preference is given to mineral oils and/or synthetic hydrocarbons. Furthermore, as the base oil, use may be made of those of a viscosity in a range of 10 $mm^2/s$ to 700 $mm^2/s$.

Additives will now be described hereinbelow.

Organopolysiloxane as an anti-foaming agent is represented by the following average unit formula:

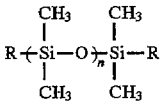

(wherein R represents hydrocarbon groups; the hydrocarbon groups may be the same or different or the hydrocarbons may be halogenated; and "n" is an integer of 200 to 1,200), and has a viscosity at 40° C. of 100 $mm^2/s$ to 100,000 $mm^2/s$, preferably 3,000 $mm^2/s$ to 60,000 $mm^2/s$. If the viscosity at 40° C. is below 100 $mm^2/s$, the anti-foaming property at higher temperatures is deteriorated disadvantageously; and if the viscosity is above 100,000 $mm^2/s$, the particle dispersion of the anti-foaming agent in a base oil gets poor disadvantageously.

In the formula, R represents an alkyl group including ethyl group, n-propyl group, i-propyl group, n-butyl group, i-butyl group, t-butyl group, n-pentyl group, neopentyl group, hexyl group, heptyl group, octyl group, decyl group, and octadecyl group; an allyl group such as phenyl group and naphthyl group; an aralkyl group such as benzyl group, 1-phenylethyl group and 2-phenylethyl group; an arallyl group such as o-, m-, p-diphenyl group; and a halogenated hydrocarbon group such as o-, m-, and p-chlorophenyl group, o-, m-, and p-bromphenyl group, 3,3,3-trifluoropropyl group, 1,1,1,3,3,3-hexafluoro-2-propyl group, heptafluoroisopropyl group and heptafluoro-n-propyl group.

Organopolysiloxane may be added at a ratio of 1 ppm to 500 ppm, preferably 5 ppm to 100 ppm.

Ethylene glycol-propylene glycol polymer is represented by the general formula (1):

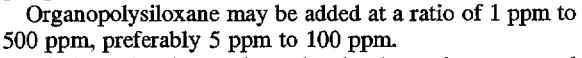

$$R_1O(C_2H_4O)_a(C_3H_6O)_b(C_2H_4O)_cR_2 \quad (1)$$

(wherein $R_1$ and $R_2$ independently represent hydrogen atom or an alkyl group with 1 to 4 carbon atoms; "a" and "c" represent an integer of 1 to 30; and "b" represents an integer of 1 to 60), wherein the ethylene oxide content in the entire molecule is at 10% by weight to 50% by weight and the weight average molecular weight is 900 to 4,000, preferably 1,500 to 3,000.

As a derivative of ethylene glycol-propylene glycol polymer, an amine condensate of ethylene glycol propylene glycol is illustrated and represented by the general formula (2):

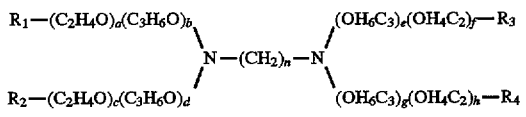

$$\begin{array}{l} R_1-(C_2H_4O)_a(C_3H_6O)_b \qquad\qquad (OH_6C_3)_e(OH_4C_2)_f-R_3 \\ \qquad\qquad\qquad\qquad N-(CH_2)_n-N \\ R_2-(C_2H_4O)_c(C_3H_6O)_d \qquad\qquad (OH_6C_3)_g(OH_4C_2)_h-R_4 \end{array} \quad (2)$$

wherein $R_1$ to $R_4$ independently represent hydrogen atom or an alkyl group with 1 to 4 carbon atoms; "a, c, f" and "h" represent an integer of 1 to 20; "b, d, e" and "g" represent an integer of 1 to 30; and "n" represents an integer of 1 to 4), wherein the ethylene oxide content in the entire molecule is at 10% by weight to 40% by weight and the weight average molecular weight is 500 to 7,000, preferably 1,500 to 5,000.

Additionally, the compound as the CAS Registry No. 68603-58-7 may be used as well.

Ethylene glycol-propylene glycol polymer or a derivative thereof may be used singly or in combination, and may be added at a ratio of 1 ppm to 5,000 ppm, preferably 50 ppm to 1,000 ppm to a base oil.

Further, ethylene glycol-propylene glycol polymer or a derivative thereof may be used in combination with organosiloxane, at a ratio of 1-fold to 1,000-fold, preferably 10-fold to 100-fold that of organosiloxane. The total amount should be at 2 ppm to 5,000 ppm, preferably at 2 ppm to 1,000 ppm, most preferably at 10 ppm to 500 ppm to a base oil.

Antioxidants, pour point decreasing agents, wear preventing agents, and rust preventive agents and metal inactivating agents may be added to the lubricant composition in accordance with the present invention.

As such antioxidants, for example, use may be made of amine antioxidants such as di(alkylphenyl)amine (the alkyl group has 4 to 20 carbon atoms), phenyl-α-naphthyl amine, alkyldiphenylamine (the alkyl group has 4 to 20 carbon atoms), N-nitrosodiphenylamine, phenothiazine, N,N'-dinaphthyl-p-phenylene diamine, acridine, N-methylphenothiazine, N-ethylphenothiazine, dipyridylamine, diphenylamine, phenol amine, and 2,6-di-t-butyl-α-dimethylamino para-cresol; phenol antioxidants such as 2,6-di-t-butyl para-cresol, 4,4'-methylene bis(2,6-di-t-butyl phenol), 2,6-di-t-butyl4-N,N-dimethylaminomethyl phenol, and 2,6-di-t-butyl phenol; organic metal antioxidants including organic iron salts such as iron octoate, ferrocene, and iron naphthoate, organic cerium salts such as cerium naphthoate and cerium toluate, and organic zirconium salts such as zirconium octoate.

The aforementioned antioxidants may be used singly, or may be used in combination with two or more so as to exhibit synergetic effects. Antioxidants should be used at a ratio of 0.001 to 5% by weight, preferably 0.01 to 2% by weight.

As the flow point decreasing agents, use may be made of polyalkylmethacrylates, chlorinated paraffins, ethylene-vinyl acetate copolymers, ethylene-alkylacrylate copolymers, and alkenylsuccinamides. These agents may be mixed at a ratio of 0.001% by weight to 5% by weight, preferably 0.01% by weight to 1.0% by weight to a base oil.

As the wear preventing agents, use may be made of zinc thiophosphate, and additionally, use may be made of phosphate ester, thiophosphate ester, phosphite ester, zinc thiocarbamate, thiocarbamate ester, polysulfide, disulfide, sulfide ester, sulfide oil and the like. Wear preventing agents may be used at 0.01% by weight to 5% by weight, preferably 0.1% by weight to 3% by weight to a base oil. The agents may be used singly or in combination of two or more.

As the rust preventing agents, use may be made of ester, carboxylic acid, amine, alcohol, phenol, carboxylate, amine salt, and sulfonate salt, including for example succinic acid, succinate ester, oleate beef tallow amide, barium sulfonate, calcium sulfonate and the like. These agents may be used at 0.01% by weight to 10% by weight, preferably 0.01% by weight to 1.0% by weight to a base oil.

As the metal inactivating agents, use may be made of benzotriazole, benzotriazole derivatives, thiadiazole, thiadiazole derivatives, triazole, triazole derivatives, dithiocarbamate and the like. These may be used at 0.001% by weight to 10% by weight, preferably 0.01% by weight to 1.0% by weight to a base oil.

Conventional use of dimethylsilicone or derivatives thereof with effective anti-foaming activity at a temperature below 100° C. are not effective in a highly viscous lubricant (VG 68 or more) at a high temperature (150° C.). Adding dimethylsilicone at a higher level (100 ppm or more), the lubricant may get opaque while precipitating dispersed silicone particles.

The present inventors have made investigations about an anti-foaming agent which makes the foaming degree and foaming stability of a highly viscous lubricant (VG 68 or more) to 50 ml or less at higher temperatures. They have found that the combined use of an anti-foaming agent dimethylsiloxane with ethylene glycol-propylene glycol polymer remarkably improves the anti-foaming property.

Ethylene glycol - propylene glycol polymer does not exhibit anti-foaming property if blended singly, and such anti-foaming effect is remarkably increased if the polymer is used in combination with dimethylpolysiloxane.

The present invention will now be explained below.

EXAMPLE 1

Lubricant compositions of Examples 1 to 4 and Comparative Examples 1 to 8 were prepared, as shown in Table 1. The composition shown in Table 1 is represented by "part by weight". The base oil and additives shown in Table 1 will now be described.

Base Oil: A hydrogenation purified mineral oil (VG 220), with a viscosity of 220 $mm^2/s$ at 40° C. and the following n-d-M ring analytical values; 70 or more of % Cp, 30 or less of % CN, 1 or less of % CA, 50 ppm or less of S components and 50 ppm or less of N components.

Antioxidant: The antioxidant in Examples 1 to 4 and Comparative Examples 1 to 8 is composed as follows; 0.2% by weight of hindered phenol, 0.2% by weight of alkylated PAN (phenyl-α-naphthylamine: the alkyl group is in a linear chain or in a branched chain of $C_4$ to $C_{12}$), and 0.1% by weight of alkylated DPN (diphenylamine: the alkyl group is in a linear chain or in a branched chain of $C_4$ to $C_{12}$).

Pour Point Decreasing Point: polymethylmethacrylate.

Rust Preventing Agent: alkenylsuccinate ester.

Anti-Foaming Agent A: dimethylpolysiloxane of a viscosity of 350 $mm^2/s$ at 40° C.

Anti-Foaming Agent B: dimethylpolysiloxane of a viscosity of 12,500 $mm^2/s$ at 40° C.

Anti-Foaming Agent C: dimethylpolysiloxane of a viscosity of 60,000 $mm^2/s$ at 40° C.

PEG-PPG Polymer A: ethylene glycol-propylene glycol polymer represented by the general formula (1) above; Pluronic L61 (as Product name), manufactured by Asahi Denka, Kabushiki Kaisha; weight average molecular weight; 2,000).

PEG-PPG Polymer B: a derivative of ethylene glycol-propylene glycol polymer represented by the general formula (1) above.

Triton CF32 (as Product name), manufactured by Rohm & Haas; weight average molecular weight; 5,700).

Anti-foaming test was done about the lubricant compositions of Examples 1 to 4 and Comparative Examples 1 to 8, according to JIS K2518 (at 93.5° C. (Seq2)) and ILSAC (at 150° C.) shown below. The results are shown simultaneously in Table 1. All the results are shown as [foam in volume (ml) immediately after foaming]/[foam in volume (ml) 5 minutes after foaming].

ILSAC: Anti-Foaming Test

1. Bath temperature should be maintained at 150°±0.5° C.
2. A lubricant composition is placed up to its 180 ml volume in a sample container, and then, the container
3. The container is immersed in the bath for 20 minutes, and an air introducer with a diffuser stone is immediately introduced into the container to be vertically held at the center of the container in contact with the bottom, for immersion of the introducer in the sample for 5 minutes.
4. Connecting the air introducer to an air supply system, dry air should be blown into the sample at a flow rate of 200±5 ml/mm for a period of 5 minutes—3 seconds since the initial foaming from the diffuser stone.
5. Stopping the supply from the air supply system, the volume of foam should be read immediately (foaming degree).
6. Leaving the whole system as it is for 5 seconds, the volume of foam should be read again (foaming stability).

| | EXAMPLE | | | | COMPARATIVE EXAMPLES | | | | | | | |
|---|---|---|---|---|---|---|---|---|---|---|---|---|
| | 1 | 2 | 3 | 4 | 1 | 2 | 3 | 4 | 5 | 6 | 7 | 8 |
| Base oil (VG220) | 100 | 100 | 100 | 100 | 100 | 100 | 100 | 100 | 100 | 100 | 100 | 100 |
| Antioxidant | 0.5 | 0.5 | 0.5 | 0.5 | 0.5 | 0.5 | 0.5 | 0.5 | 0.5 | 0.5 | 0.5 | 0.5 |
| Flow point decreasing agent | 0.2 | 0.2 | 0.2 | 0.2 | 0.2 | 0.2 | 0.2 | 0.2 | 0.2 | 0.2 | 0.2 | 0.2 |
| Wear preventing agent | 0.5 | 0.5 | 0.5 | 0.5 | 0.5 | 0.5 | 0.5 | 0.5 | 0.5 | 0.5 | 0.5 | 0.5 |
| Rust preventing agent | 0.1 | 0.1 | 0.1 | 0.1 | 0.1 | 0.1 | 0.1 | 0.1 | 0.1 | 0.1 | 0.1 | 0.1 |
| Anti-foaming agent A | | | | | | 0.001 | | | | | 0.001 | 0.001 |
| Anti-foaming agent B | 0.001 | | 0.001 | | | | 0.001 | | | | | |
| Anti-foaming agent C | | 0.001 | | 0.001 | | | | 0.001 | | | | |
| PEG-PPG polymer A | 0.005 | 0.005 | | | | | | | 0.005 | | 0.005 | |
| PEG-PPG polymer B | | | 0.005 | 0.005 | | | | | | 0.005 | | 0.005 |
| Anti-foaming property* | 0/0 | 0/0 | 0/0 | 0/0 | 500/200 | 0/0 | 0/0 | 0/0 | 310/30 | 280/50 | 0/0 | 0/0 |
| ISLAC 150 C. | 20/0 | 30/10 | 0/0 | 30/20 | 620/570 | 640/480 | 410/360 | 200/150 | 690/560 | 600/550 | 600/450 | 540/470 |

*Foaming degree/Foaming stability

We claim:

1. A lubricant composition comprising 1 ppm to 500 ppm of organo polysiloxane with a viscosity of 1,000 $mm^2/s$ at 40° C. and 1 ppm to 5,000 ppm of tetra poly alkylene oxide amine in a base oil having a viscosity of 10 $mm^2/s$ to 700 $mm^2/s$ at 40° C.

2. The lubricant composition of claim 1 wherein the organopolysiloxane is of the formula

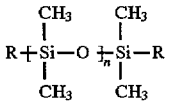

wherein R is the same or different hydrocarbon groups or halohydrocarbon groups and n is an integer of 200 to 1,200.

3. The lubricant composition of claim 1 wherein the tetra polyalkylene oxide amine is of the formula

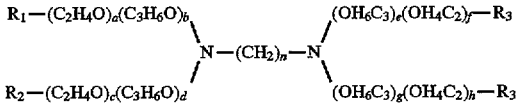

(2)

wherein $R_1$ to R4 independently represent hydrogen or an alkyl group of 1 to 4 carbon atoms, a, c, f and h represent an integer of 1 to 20, b, d, e and g represent an integer of 1 to 30 and n represents an integer of 1 to 4.

* * * * *